US007187285B2

(12) United States Patent
Staples

(10) Patent No.: US 7,187,285 B2
(45) Date of Patent: Mar. 6, 2007

(54) SYSTEM TO DETECT MAIL IN A MAILBOX

(75) Inventor: Peter Ethan Staples, Los Angeles, CA (US)

(73) Assignee: Blue Clover Design, LLC, Los Angeles, CA (US)

( * ) Notice: Subject to any disclaimer, the term of this patent is extended or adjusted under 35 U.S.C. 154(b) by 78 days.

(21) Appl. No.: 10/966,051

(22) Filed: Oct. 14, 2004

(65) Prior Publication Data

US 2005/0122220 A1 Jun. 9, 2005

Related U.S. Application Data

(60) Provisional application No. 60/510,979, filed on Oct. 14, 2003.

(51) Int. Cl.
*G08B 13/14* (2006.01)

(52) U.S. Cl. ..... 340/569; 200/61.63

(58) Field of Classification Search ..... 340/569; 200/61.63
See application file for complete search history.

(56) References Cited

U.S. PATENT DOCUMENTS 1,131,211 A * 3/1915 Collier ..... 340/569
1,307,305 A * 6/1919 Newquist ..... 340/569
3,222,665 A * 12/1965 Tracy ..... 340/549
4,868,543 A * 9/1989 Binkley ..... 340/569
5,023,595 A * 6/1991 Bennett ..... 340/569
5,377,906 A 1/1995 Mason
5,816,489 A 10/1998 Stockman
6,155,482 A 12/2000 Perry
6,433,684 B1 * 8/2002 Lie ..... 340/569
6,462,659 B1 * 10/2002 Schuette ..... 340/569
6,816,074 B2 * 11/2004 Wong ..... 340/569

OTHER PUBLICATIONS

Gizmo City, Wireless Mail Alert, Web Page, http://www.gizmocity.com/mailalert.asp.

* cited by examiner

*Primary Examiner*—John Tweel, Jr.
(74) *Attorney, Agent, or Firm*—Jeffrey Schox

(57) ABSTRACT

In a first embodiment, the system 10 includes a sensor 12, a transmitter 14 coupled to the sensor 12 and adapted to transmit a signal, a receiver 16 adapted to receive the signal, and a remote indicator 18 coupled to the receiver 16. In a second embodiment, the receivers 16' are actually transceivers that can retransmit the signals to a receiver 16' of another remote indicator 18 and that cooperatively form a mesh network. This arrangement may be quite useful in certain environments, such as a tall apartment building and a long private street, where multiple users are relatively spread out.

15 Claims, 3 Drawing Sheets

SYSTEM TO DETECT MAIL IN A MAILBOX

CROSS-REFERENCE TO RELATED APPLICATIONS

This application claims the benefit of U.S. Provisional Application No. 60/510,979 filed 14 Oct. 2003, which is incorporated in its entirety by this reference.

TECHNICAL FIELD

This invention relates generally to the mailbox field, and more specifically to an improved system to detect and remotely signal the presence or absence of mail in a mailbox.

DESCRIPTION OF THE PREFERRED EMBODIMENTS

The following description of preferred embodiments of the invention is not intended to limit the invention to these two embodiments, but rather to enable any person skilled in the art to make and use this invention.

The invention includes a system to detect and remotely signal the presence or absence of physical items in or on a particular environment. More specifically, the invention includes a system to detect and remotely signal the presence or absence of mail in a mailbox.

Figure 1:
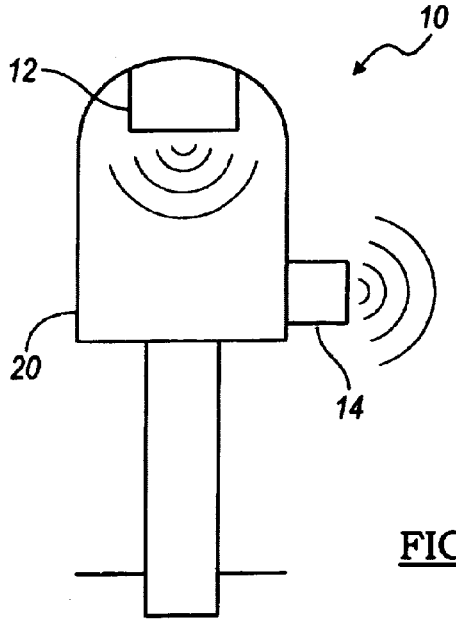
FIGS. 1 and 2 are schematic drawings of the system of the first embodiment.
Figure 2:
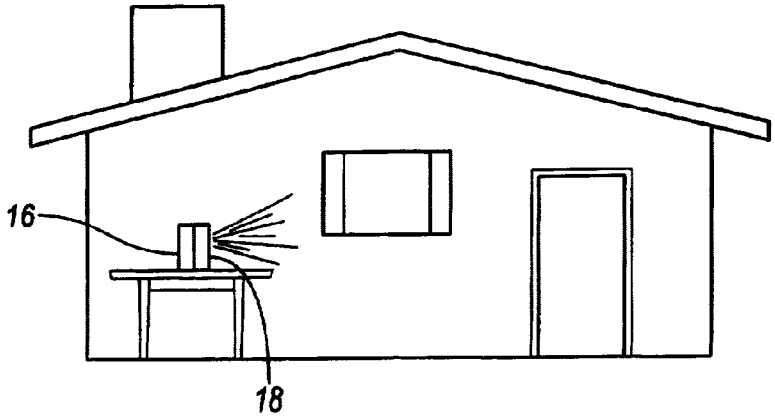

As shown in FIGS. 1 and 2, the system 10 of the first embodiment includes a sensor 12, a transmitter 14 coupled to the sensor 12 and adapted to transmit a signal, a receiver 16 adapted to receive the signal, and a remote indicator 18 coupled to the receiver 16. Although the system 10 is preferably designed as a kit for an existing mailbox 20, the system 10 could also be incorporated into a new design of a mailbox to optimize the sensing of mail and to reduce theft and tampering.

The sensor 12 of the first embodiment functions to sense the presence or absence of mail in the mailbox 20. The sensor 12 is preferably either an active sensor, which senses at predetermined intervals, or a passive sensor, which senses after a particular event. Active sensors include electromagnetic wave devices (such as a radar device) and sound wave devices (such as an echolocation device) that actively produce and sense waves. With an active sensor, the system 10 preferably includes a CPU that responds to the sensed waves. Passive sensors include IR sensors (such as certain motion detectors) and weight or pressure sensors (such as a scale) that are activated upon the occurrence of a particular event. Passive sensors may also include switches that are activated by a mail-carrier, such as switches that are activated by the opening of the mailbox. Although any suitable device may be used, the sensor 12 of the first embodiment includes an active IR sensor 12.

Figure 3:
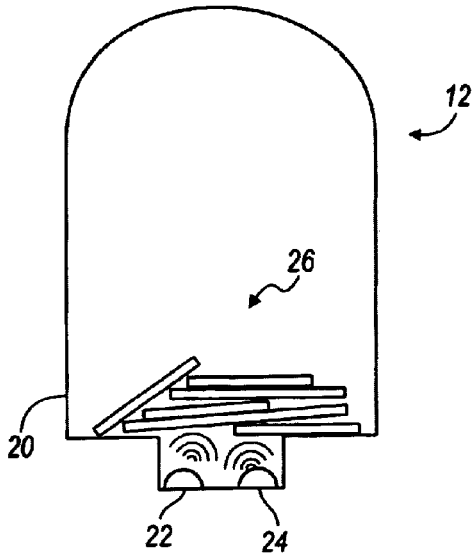
FIGS. 3 and 4 are schematic drawings of two variations of the sensor of the system of the first embodiment.
Figure 4:
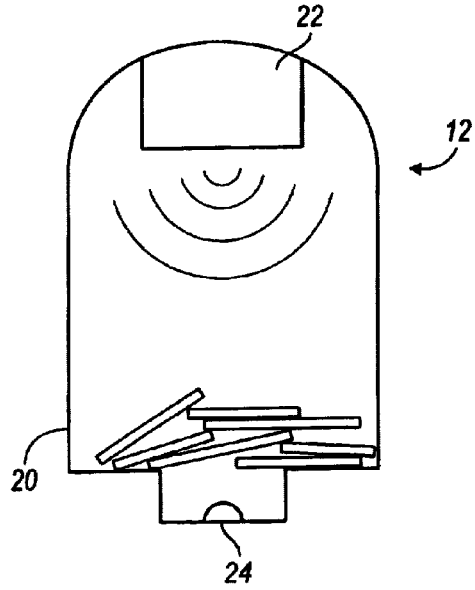

The sensor 12 of the first embodiment preferably consists of one or more infrared (IR) sensors arranged in one of several possible configurations. In a first variation, as shown in FIG. 3, the sensor 12 includes an IR transmitter 22 and an IR detector 24 right next to one another within a cavity inside the floor of the mailbox 20. When no mail is present the IR detector 24 does not detect anything, but when mail 26 is present the signal from the IR transmitter 22 is reflected off the mail 26 toward the IR detector 24. This arrangement may be in the form of multiple transmitter/detector pairs so that a larger area may be covered. In a second variation, as shown in FIG. 4, the sensor 12 includes an IR transmitter 22 on one interior surface of the mailbox 20 and an IR detector 24 on an opposite interior surface. When the IR signal is received by the IR detector 24, the mailbox 20 is known to be empty. When mail 26 is present in the mailbox 20, the IR signal is interrupted and the IR detector 24 does not sense anything. The sensor 12 may, of course, include other suitable devices or arrangements to detect the presence or absence of mail in the mailbox.

As shown in FIGS. 1 and 2, the transmitter 14 and receiver 16 of the first embodiment function to transmit a signal from the mailbox 20 to a remote location. The link between the transmitter 14 and the receiver 16 may include physical links, airwave links, or a combination of physical and airwave links. In one variation, the transmitter 14 transmits a radio frequency (RF) signal and the receiver 16 receives the RF signal. In another variation, the transmitter 14 transmits a signal over the telephone system and the receiver 16 (possibly a pager, a land-based telephone, a cellular-based telephone, a satellite-based telephone, or any other suitable telephone) receives the signal. In another variation, the transmitter 14 transmits a signal over a network (possibly a wireless local access network or the internet using an internet protocol address) and the receiver 16 (possibly an email program, an instant-messenger program, or a specialized program) receives the signal. Although the transmitter 14 and receiver 16 could be any suitable electromagnetic wave device (such as an RF transmitter) or a sound wave device (such as an infrasound device), the transmitter 14 and receiver 16 are preferably RF devices.

The transmitter 14 of the first embodiment preferably automatically transmits the status of the mailbox as an RF signal to a physically separate display unit. This RF signal preferably operates on a carrier wave of 315 MHz, 433 MHz, 900 MHz, or another suitable frequency. There are several possible ways to schedule these transmissions. One option is to transmit whenever a change of state is detected. For example, if mail is initially present but the mail is removed, this new state would be transmitted to the display unit. Another option is to periodically transmit the current state of the mailbox. Thus, every period, the sensor 12 would check the current state and the transmitter 14 would send that state information to the display unit. The transmitter 14 may, however, transmit the status after the occurrence of any suitable event or at any suitable period.

The transmitter 14 of the first embodiment preferably transmits a sequence of bits that is 'known' by the receiver 16 in the display unit. This known sequence is called the header and it is used to identify the mailbox 20, allowing the receiver 16 to differentiate between the mailbox 20 and other mailboxes that might happen to be within receiving range. The transmitter 14 may alternatively use other ways, such as frequencies, to identify the mailbox 20.

To reduce energy consumption, the receiver 16 of the first embodiment will often be in a sleep mode. In a first variation, the system 10 preferably includes a microcontroller that functions to 'wake-up' the receiver 16 at predetermined times so that it can receive potential transmissions from the mailbox 20. The header of the transmission is preferably preceded by a preamble, which is a longer sequence of bits used to help synchronize the transmitter 14 and the receiver 16. The microcontroller preferably wakes up the receiver 16 on a periodic cycle, which is less than the duration of the preamble in the transmission. This ensures that, if a transmission is occurring, the receiver 16 will receive at least some part of it. In a second variation, the transmitter 14 and the receiver 16 adhere to the ZigBee protocol, with the optional "beacon" mode. The ZigBee protocol, which was designed for applications with low data rates and low power consumption, is based on the IEEE 802.15.4 standard for wireless personal area networking. In the optional "beacon" mode, the transmitter 14 transmits a periodic beacon message, which wakes up the receiver 16 from sleeping mode. After awake, the receiver 16 listens for a particular header and—if appropriate—listens for a signal or message. Afterwards, the receiver 16 returns to sleep mode. The system 10, the transmitter 14, and the receiver 16 may alternatively use other methods or devices to reduce energy consumption.

Figure 5:
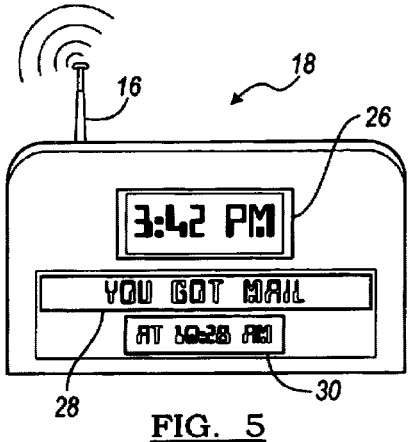
FIGS. 5 and 6 are schematic drawings of two variations of the remote indicator of the system of the first embodiment.
Figure 6:
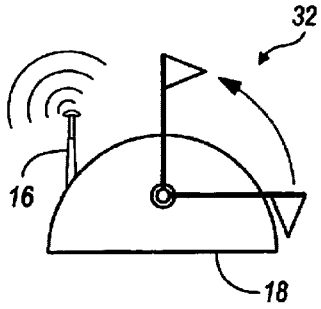

The remote indicator 18 of the first embodiment functions to communicate the presence or absence of mail in the mailbox 20 to a user of the system 10 and to accept a reset command from the user. In one variation, the remote indicator 18 includes a visible light source (such as a LED), which preferably blinks or shines when mail is present in the mailbox 20. In a further development of this variation, as shown in FIG. 5, the remote indicator 18 includes an LCD with clock 26, thermometer, or other useful information along with a message or icon 28 indicating the presence (or absence) of mail in the mailbox 20. If a clock 26 is included in either the mailbox unit or the display unit, a time-stamping feature may be implemented, such that when the arrival of mail is detected, the current time is recorded and conveyed by a device 30 of the remote indicator 18.

In another variation, the remote indicator 18 of the first embodiment includes a sound source (such as a computer speaker), which could emit a simple beep, a ring-tone playing some sort of melody, or a voice synthesizer of some kind. As a further development of this variation, the remote indicator 18 could include a sound recording mechanism so that the user can personalize the remote indicator 18 to suit their preference.

In another embodiment, the remote indicator 18 of the first embodiment includes one or more mechanical devices, such as a spring-loaded arm 32, which moves from a first position to a second position when mail is present in the mailbox. Unlike the light and sound devices of the previous variations, the mechanical device 32 could be configured to signal once until the remote indicator 18 is reset.

The remote indicator 18 of the first embodiment is preferably a desktop device, but may alternatively be a wall mounted device or a portable device, such as a wristwatch or pager-like device that clips onto the belt, which gives the user mobile access to the information. It is possible that such an implementation would include a wall mount or a desktop cradle so that the portable display unit could either be used in its portable form or be placed onto the wall or onto a desk.

Figure 7:
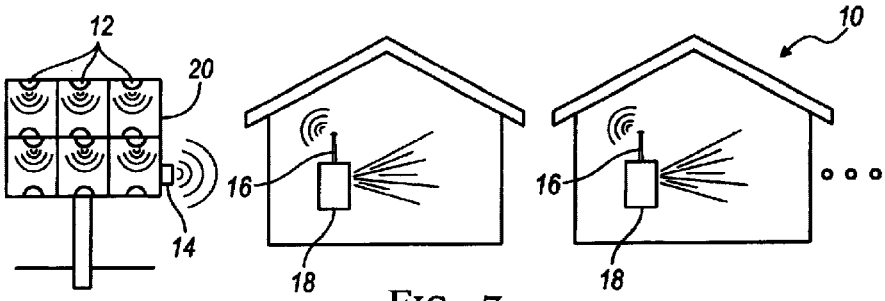
FIG. 7 is a schematic drawing of the system of the first embodiment with multiple receivers.

As shown in FIG. 7, the system 10 of the first embodiment may include more than one remote indicator 18 so that multiple users can be informed of the presence of mail in their mailboxes. This arrangement may be quite useful in certain environments, such as either a lobby of an apartment building or the beginning of a private street, where multiple mailboxes are located. This arrangement may include multiple transmitters that transmit a signal for each mailbox, one transmitter that transmits a signal for each mailbox, one transmitter that transmits one signal for all mailboxes, or any other suitable arrangement. As a variation, the remote indicator 18 could receive signals from multiple transmitters and communicate the presence or absence of mail in these mailboxes to the users of the system 10.

Figure 8:
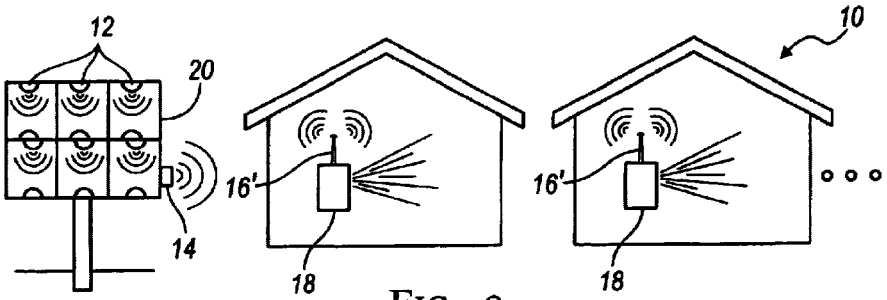
FIG. 8 is a schematic drawing of the system of the second embodiment with multiple receivers.

As shown in FIG. 8, the system 10' of the second embodiment is nearly identical to the system 10 of the first embodiment. The difference between the two embodiments, however, is that the receivers 16' of the second embodiment are actually transceivers that can retransmit the signals to a receiver 16' of another remote indicator 18. In this embodiment, the receivers 16' preferably cooperatively form a mesh network that can increase the probability that the receivers 16' will receive the signals from the transmitter 14, and that can increase the distance from the furthest receiver 16' to the transmitter 14. This arrangement may be quite useful in certain environments, such as a tall apartment building and a long private street, where multiple users are relatively spread out.

The system 10 of either the first or second embodiment may be incorporated into a larger network by the postal system. A mail carrier could send a signal to a regional or central processing office after the delivery of mail to a particular mailbox. This information could be used to analyze the efficiency or effectiveness of the mail carrier. This information could also be used as an alternative or supplement to delivery confirmation for the sender of the mail. Further, this information could be used to prevent the needless delivery of mail to users that are on vacation and haven't checked their mail in several days. A related signal could be sent to the customer, via the internet or any other suitable network, to signal the presence or absence of mail in their mailbox.

As a person skilled in the art will recognize from the previous detailed description and from the figures and claims, modifications and changes can be made to the preferred embodiments of the invention without departing from the scope of this invention defined in the following claims.

I claim:

1. A mailbox system, comprising:

a mailbox cluster having a first mailbox with a first sensor, a second mailbox with a second sensor, and a transmitter coupled to the first sensor and the second sensor and adapted to transmit a signal;

a first remote unit having a first receiver and a first indicator, wherein the first receiver is adapted to receive the signal from the mailbox cluster, and wherein the first indicator is coupled to the first receiver and is adapted to communicate the presence of mail in the first mailbox; and a second remote unit having a second receiver and a second indicator, wherein the second receiver is adapted to receive a signal from the mailbox cluster and from the first remote unit, and wherein the second indicator is coupled to the second receiver and is adapted to communicate the presence of mail in the second mailbox;

wherein the first receiver is further adapted to retransmit the signal to the second receiver.

2. The system of claim 1 wherein the first sensor and the second sensor are adapted to sense at predetermined intervals.

3. The system of claim 2 wherein the first sensor and the second sensor include an IR transmitter and an IR detector.

4. The system of claim 3 wherein the first sensor and the second sensor are configured such that mail will reflect an IR signal from the IR transmitter to the IR detector.

5. The system of claim 3 wherein the first sensor and the second sensor are configured such that mail will interrupt an IR signal between the IR transmitter and the IR detector.

6. The system of claim 1 wherein the first transmitter and the second transmitter are further adapted to transmit a RF signal, and wherein the first receiver and the second receiver are further adapted to receive a RF signal.

7. The system of claim 1 wherein the first transmitter is further adapted to transmit a signal that identifies the first mailbox and the second transmitter is further adapted to transmit a signal that identifies the second mailbox.

8. The system of claim 7 wherein the first receiver is further adapted to differentiate between a signal that identifies the first mailbox and a signal that identifies the second mailbox.

9. The system of claim 8 wherein the first receiver is further adapted to receive the signal that identifies the second mailbox and to communicate the presence of mail in the first mailbox and the presence of mail in the second mailbox.

10. The system of claim 8 wherein the first receiver is further adapted to retransmit the signal that identifies the second mailbox to the second receiver.

11. The system of claim 8 wherein the second receiver is further adapted to differentiate between the signal that identifies the first mailbox and the signal that identifies the second mailbox.

12. The system of claim 1 wherein the first indicator includes a clock.

13. The system of claim 12 wherein the first indicator is further adapted to timestamp a state change from an absence of mail in the first mailbox to the presence of mail in the first mailbox; and wherein the first indicator is further adapted to convey the approximate time of the state change.

14. The system of claim 1 wherein the first indicator includes a mechanical device that moves from a first position to a second position, and wherein the second position signals a state change from the absence of mail in the first mailbox to the presence of mail in the first mailbox.

15. The system of claim 14 wherein the mechanical device can be reset from the second position to the first position.

* * * * *